US011138950B1

(12) United States Patent
Kuo et al.

(10) Patent No.: US 11,138,950 B1
(45) Date of Patent: Oct. 5, 2021

(54) IMAGE DATA SKIPPING FOR TRANSMISSION TO ELECTRONIC DISPLAY

(71) Applicant: Apple Inc., Cupertino, CA (US)

(72) Inventors: Tien-Chien Kuo, Sunnyvale, CA (US); Ivan Knez, San Jose, CA (US); Bilin Wang, Santa Clara, CA (US); Hopil Bae, Palo Alto, CA (US); Kanghoon Jeon, Albany, CA (US); Chun-Yao Huang, San Jose, CA (US); Denis Michel Darmon, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/688,898

(22) Filed: Nov. 19, 2019

Related U.S. Application Data

(60) Provisional application No. 62/782,939, filed on Dec. 20, 2018.

(51) Int. Cl.
*G09G 5/00* (2006.01)

(52) U.S. Cl.
CPC ..... *G09G 5/003* (2013.01); *G09G 2300/0842* (2013.01); *G09G 2330/023* (2013.01); *G09G 2370/02* (2013.01)

(58) Field of Classification Search
CPC ..... G09G 3/3648; G09G 2320/0261; G09G 2330/021; G09G 2310/027; G09G 2310/04; G09G 2370/08; G09G 3/3685; G09G 2320/0686; G09G 2320/103; G09G 2330/022; G09G 3/3666; G06T 9/00
See application file for complete search history.

(56) References Cited

U.S. PATENT DOCUMENTS

| | | | | |
|---|---|---|---|---|
| 8,736,545 | B2 | 5/2014 | Sakamoto et al. | |
| 2007/0069991 | A1 | 3/2007 | Lee et al. | |
| 2011/0242088 | A1* | 10/2011 | Kim | G09G 3/3685 345/214 |
| 2015/0356898 | A1* | 12/2015 | Jeon | G09G 5/008 345/690 |
| 2019/0295455 | A1 | 9/2019 | Goodson et al. | |

* cited by examiner

*Primary Examiner* — Hau H Nguyen
(74) *Attorney, Agent, or Firm* — Fletcher Yoder, P.C.

(57) ABSTRACT

Efficiently transmitting image data to an electronic display may be provided by skipping regions of the electronic display that display a default value. The electronic display may include a number of pixels, a row driver, and a data driver. The row driver may activate a first subset of the pixels for programming. The data driver may program a default pixel value to respective pixels of the first subset of the pixels for which image data has not been received and may program image data to respective pixels of the first subset of the pixels for which image data has been received.

22 Claims, 17 Drawing Sheets

IMAGE DATA SKIPPING FOR TRANSMISSION TO ELECTRONIC DISPLAY

CROSS-REFERENCE TO RELATED APPLICATIONS

This application claims priority to U.S. Provisional Patent Application No. 62/782,939, entitled "Image Data Skipping for Transmission to Electronic Display," filed on Dec. 20, 2018, which is incorporated herein by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Electronic displays are found in numerous electronic devices, from mobile phones to computers, televisions, automobile dashboards, and many more. Electronic displays operate by varying an amount of light that is output from individual pixels based on image data for each pixel. By emitting different amounts of light from pixels of different colors—often red, green, or blue—images can be displayed.

A processor of an electronic device may generate the image data and send the image data to the electronic display. The electronic display may use the image data to program the pixels of the electronic display. As modern electronic displays gain increasingly higher resolutions, the amount of image data involved in programming those electronic displays has grown correspondingly. Consequently, transmitting the image data to the electronic display may take a higher bandwidth, which may consume a substantial amount of energy.

To reduce power consumption involved in transmitting image data to an electronic display, the image data may be compressed by avoiding transmitting image data for certain regions of the electronic display that will be displaying a default pixel value. This reduces the bandwidth involved in transmitting the image data for the electronic display, and therefore may permit communication circuitry to enter a sleep mode to save power. Moreover, data paths for carrying image data to different parts of a data driver of the electronic display may be turned off when those portions of the data driver do not receive image data (instead displaying the default pixel value).

Indeed, in many cases, a line of image data that is displayed on the electronic display may have regions where all of the pixels have the same value. In one example, a line of image data may have regions where all of the pixels are black. In this case, black may be set as a default pixel value, and the image data pertaining to those regions (e.g., all black pixels) may not be transmitted to the electronic display. Instead, the electronic display may receive a signal that indicates which regions are to display the default pixel value and only image data for regions that do not entirely display the default pixel value may be transmitted.

In one example, a compressed image data signal for a line of pixels of the electronic display may include a header that contains a region identifier and a payload that contains image data (if any). The region identifier may identify which regions of the line of pixels will display the default value and which regions of the line of pixels will have at least one pixel not of the default value. Image data corresponding to the regions that will display the default value can be skipped. Thus, the payload of the compressed image data signal may include less image data than the entire line of pixels when certain regions of the line of pixels are the default value. Thus, communication circuitry and/or other data paths may be able to spend more time in a sleep mode to save power.

BRIEF DESCRIPTION OF THE DRAWINGS

Various aspects of this disclosure may be better understood upon reading the following detailed description and upon reference to the drawings in which.

DETAILED DESCRIPTION

Figure 1:
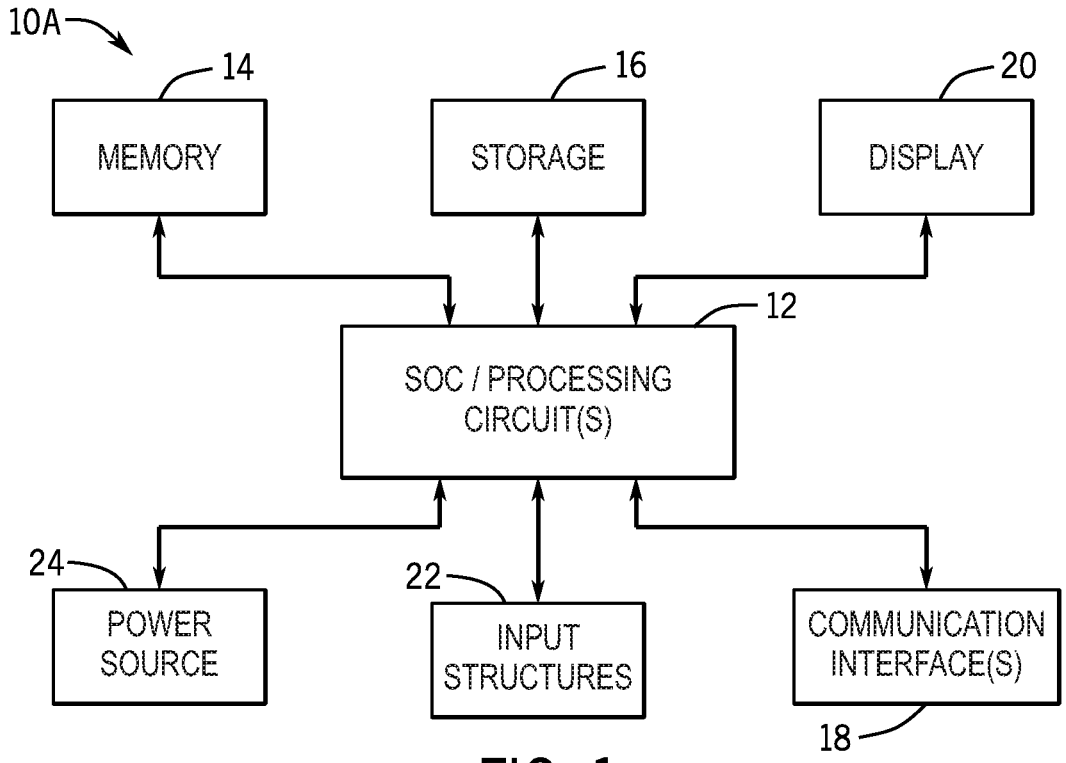
FIG. 1 is a schematic block diagram of an electronic device having an integrated electronic display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays operate by varying an amount of light that is output from individual pixels based on image data for each pixel. By emitting different amounts of light from pixels of different colors—often red, green, or blue—images can be displayed. A processor of an electronic device may generate the image data and transmit the image data to the electronic display. The electronic display may use the image data to program the pixels of the electronic display. As modern electronic displays gain increasingly higher resolutions, the amount of image data involved in programming those electronic displays has grown.

To reduce power consumption involved in transmitting image data to an electronic display, the image data may be compressed by avoiding transmitting image data for certain regions of the electronic display that will be displaying a default pixel value. This reduces the bandwidth involved in transmitting the image data for the electronic display, and therefore may permit communication circuitry to enter a sleep mode to save power. Moreover, data paths for carrying image data to different parts of a data driver of the electronic display may be turned off when those portions of the data driver do not receive image data (since those portions of the data driver may display the default pixel value).

Indeed, in many cases, a line of image data that is displayed on the electronic display may have regions where all of the pixels have the same value. In one example, a line of image data may have regions where all of the pixels are black. In this case, black may be set as a default pixel value, and the image data pertaining to those regions (e.g., all black pixels) may not be transmitted to the electronic display. Instead, the electronic display may receive a signal that indicates which regions are to display the default pixel value and only may receive image data for regions that do not entirely display the default pixel value.

Figure 2:
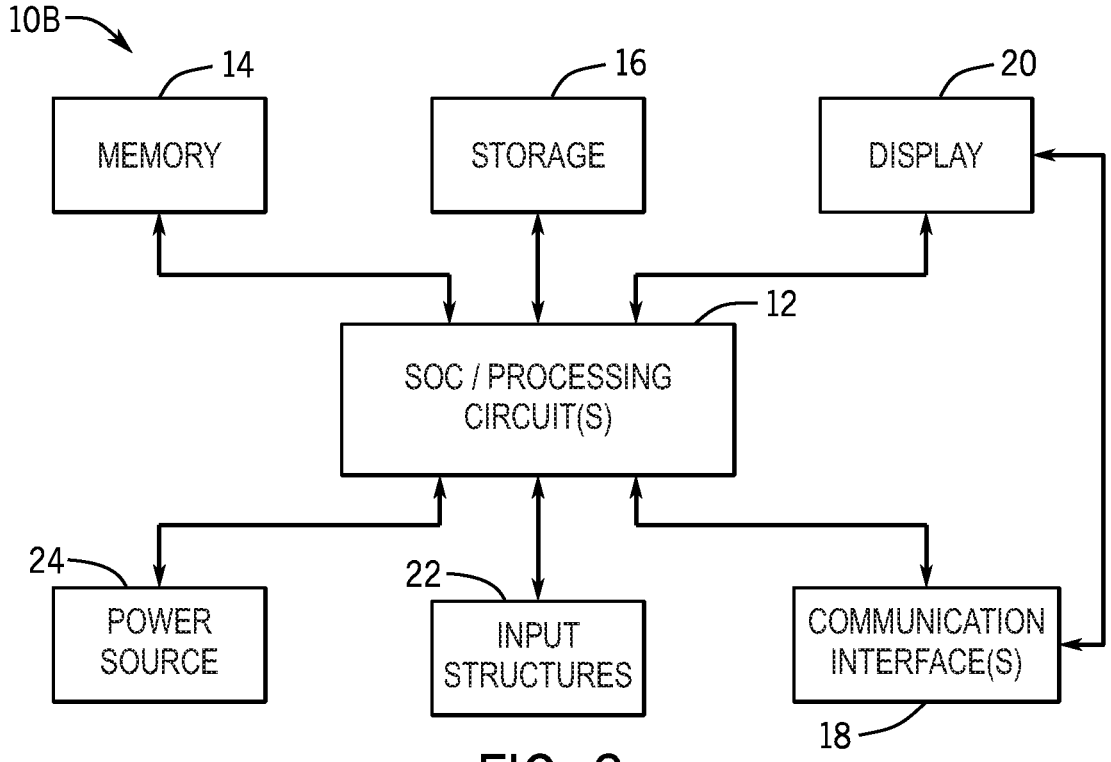
FIG. 2 is a schematic block diagram of another example of an electronic device having an external electronic display, in accordance with an embodiment.

A variety of electronic devices may employ the image data compression of this disclosure. One example of a suitable electronic device system 10A appears in FIG. 1 and may include, among other things, processor(s) such as a system on a chip (SoC) and/or processing circuit(s) 12, a local memory 14, a main memory storage device 16, communication interface(s) 18, an electronic display 20 that may be integrated into the electronic device system 10A, input structures 22, and a power source 24. Another suitable electronic device system 10B appears in FIG. 2. The electronic device system 10B may include similar components. As shown in FIG. 2, the electronic display 20 of the electronic device system 10B may be an external display that communicates with other components of the electronic device system 10B via a wired or wireless communication interface. The blocks shown in FIGS. 1 and 2 may each represent hardware, software, or a combination of both hardware and software. Moreover, an actual implementation may include more or fewer elements.

The SoC/processing circuit(s) 12 of the electronic device system 10A or 10B may perform various data processing operations, including generating and/or processing image data for display on the electronic display 20, in combination with the local memory 14 and/or the main memory storage device 16. For example, instructions that are executed by the SoC/processing circuit(s) 12 may be stored on the local memory 14 and/or the main memory storage device 16. In addition to instructions for the SoC/processing circuit(s) 12, the local memory 14 and/or the main memory storage device 16 may also store data to be processed by the SoC/processing circuit(s) 12. By way of example, the local memory 14 may include random access memory (RAM) and the main memory storage device 16 may include read only memory (ROM), rewritable non-volatile memory such as flash memory, hard drives, optical discs, or the like.

The electronic device system 10A or 10B may use the communication interface(s) 18 to communicate with various other electronic devices or elements. The communication interface(s) 18 may include input/output (I/O) interfaces and/or network interfaces. Such network interfaces may include those for a personal area network (PAN) such as Bluetooth, a local area network (LAN) or wireless local area network (WLAN) such as Wi-Fi, and/or for a wide area network (WAN) such as a cellular network.

Using pixels of any suitable type (e.g., digital micromirror device (DMD) pixels, OLED pixels, LCD pixels), the electronic display 20 may show images generated by the SoC/processing circuit(s) 12. The electronic display 20 may include touchscreen functionality for users to interact with a user interface appearing on the electronic display 20. Input structures 22 may also enable a user to interact with the electronic device system 10A or 10B. In some examples, the input structures 22 may represent hardware buttons, which may include volume buttons or a hardware keypad. The power source 24 may include any suitable source of power for the electronic device system 10A or 10B. This may include a battery within the electronic device system 10A or 10B and/or a power conversion device to accept alternating current (AC) power from a power outlet.

Figure 3:
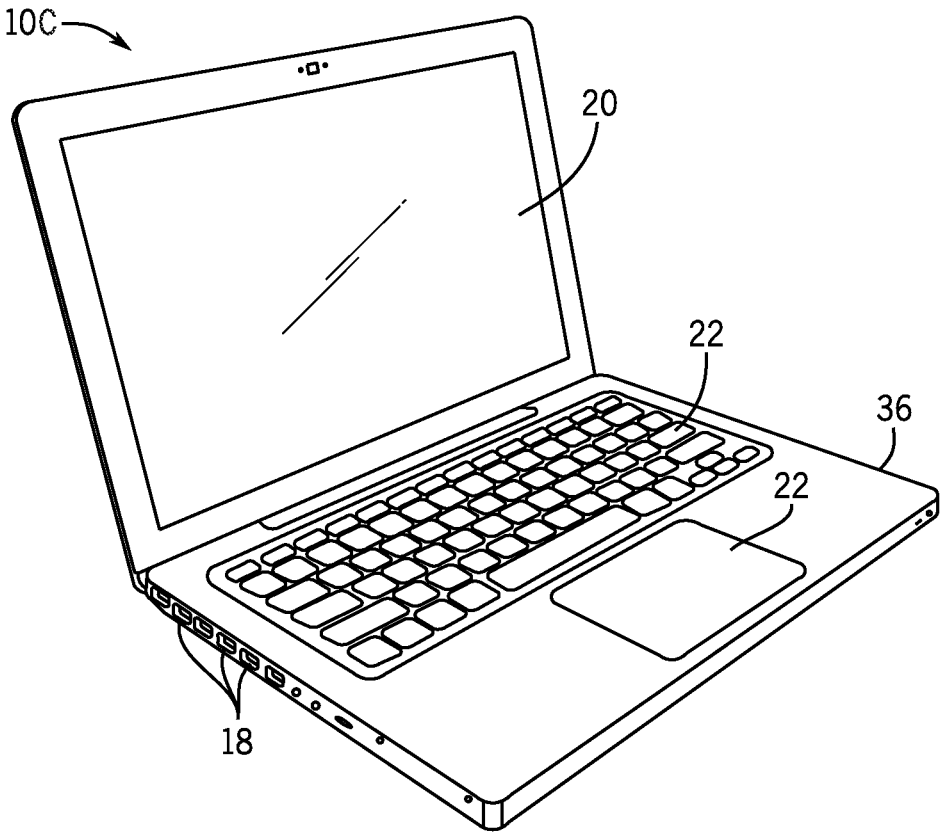
FIG. 3 is a perspective view of a notebook computer representing an embodiment of the electronic device of FIG. 1.

As may be appreciated, the electronic device system 10A or 10B may take a number of different forms. For instance, the electronic device system 10A or 10B may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device system 10A or 10B in the form of a computer may be a model of a MacBook®, MacBook® Pro, MacBook Air®, iMac®, Mac® mini, or Mac Pro® available from Apple Inc. By way of example, the electronic device system 10A or 10B, taking the form of a notebook computer 10C, is illustrated in FIG. 3 in accordance with one embodiment of the present disclosure. The depicted computer 10C may include a housing or enclosure 36, an electronic display 20, input structures 22, and ports of a communication interface 18. In one embodiment, the input structures 22 (such as a keyboard and/or touchpad) may be used to interact with the computer 10C, such as to start, control, or operate a graphical user interface (GUI) or applications running on computer 10C. For example, a keyboard and/or touchpad may allow a user to navigate a user interface or application interface displayed on the electronic display 20.

Figure 4:
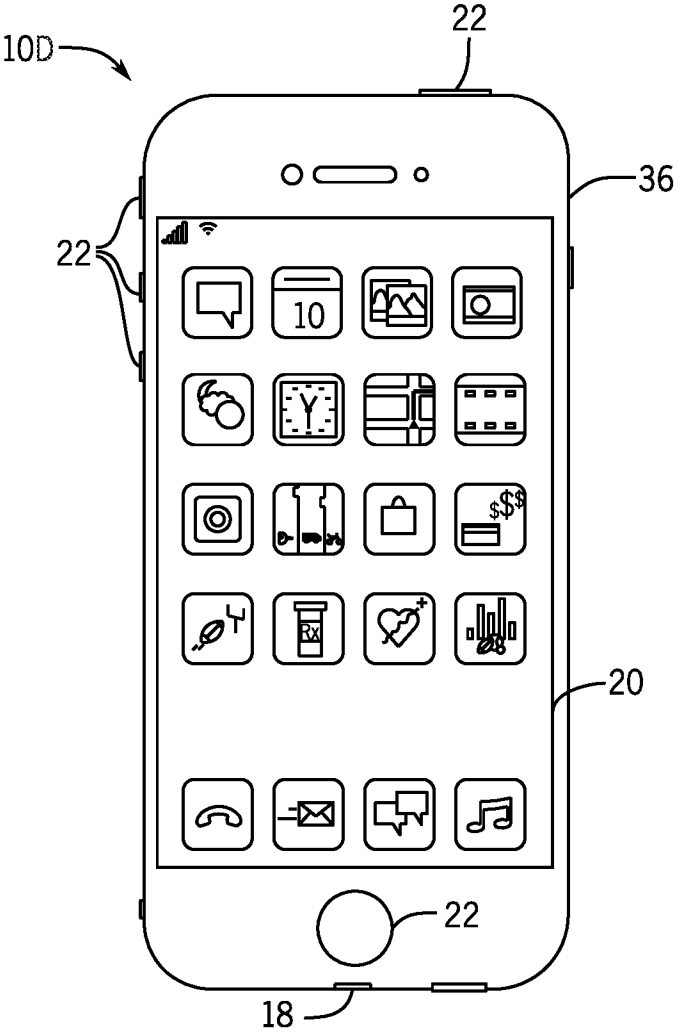
FIG. 4 is a front view of a hand-held device representing another embodiment of the electronic device of FIG. 1.

FIG. 4 depicts a front view of a handheld device 10D, which represents another example embodiment of the electronic device system 10A or 10B. The handheld device 10D may represent, for example, a portable phone, a media player, a personal data organizer, a handheld game platform, or any combination of such devices. By way of example, the handheld device 10D may be a model of an iPod® or iPhone® available from Apple Inc. of Cupertino, Calif. The handheld device 10D may include an enclosure 36 to protect interior components from physical damage and to shield them from electromagnetic interference. The enclosure 36 may surround the electronic display 20. The communication interfaces 18 may open through the enclosure 36 and may include, for example, an I/O port for a hard wired connection for charging and/or content manipulation using a standard connector and protocol, such as the Lightning connector provided by Apple Inc., a universal serial bus (USB), or other similar connector and protocol.

User input structures 22, in combination with the electronic display 20, may allow a user to control the handheld device 10D. For example, the input structures 22 may activate or deactivate the handheld device 10D, navigate user interface to a home screen, a user-configurable application screen, and/or activate a voice-recognition feature of the handheld device 10D. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

Figure 5:
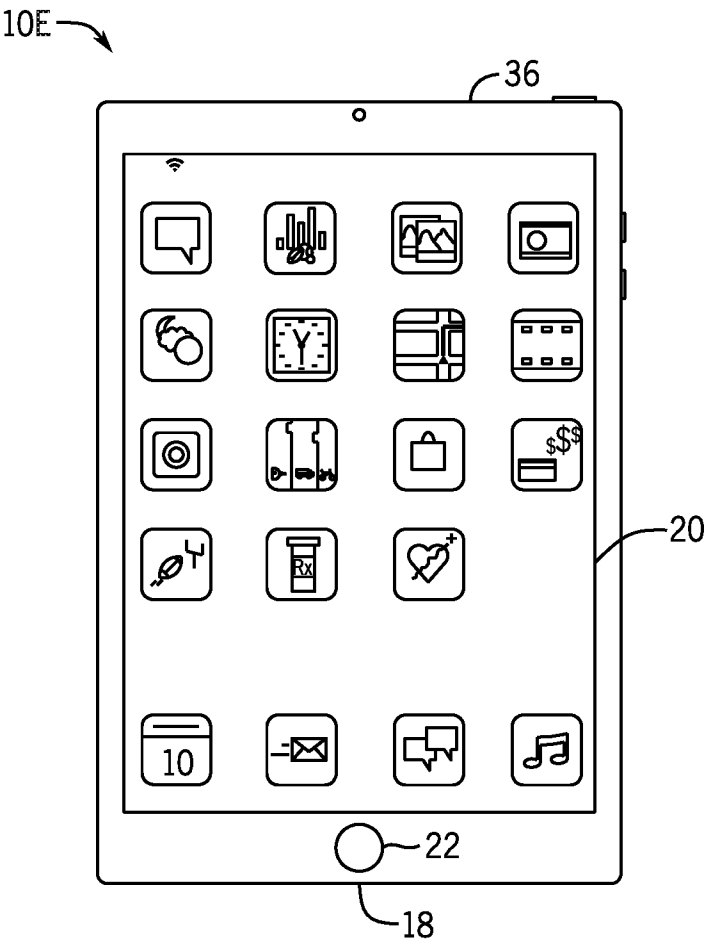
FIG. 5 is a front view of another hand-held device representing another embodiment of the electronic device of FIG. 1.

FIG. 5 depicts a front view of another handheld device 10E, which represents another embodiment of the electronic device systems 10A, 10B. The handheld device 10E may represent, for example, a tablet computer or portable computing device. By way of example, the handheld device 10E may be a tablet-sized embodiment of the electronic device system 10A or electronic device system 10B, which may be, for example, a model of an iPad® available from Apple Inc. of Cupertino, Calif.

Figure 6:
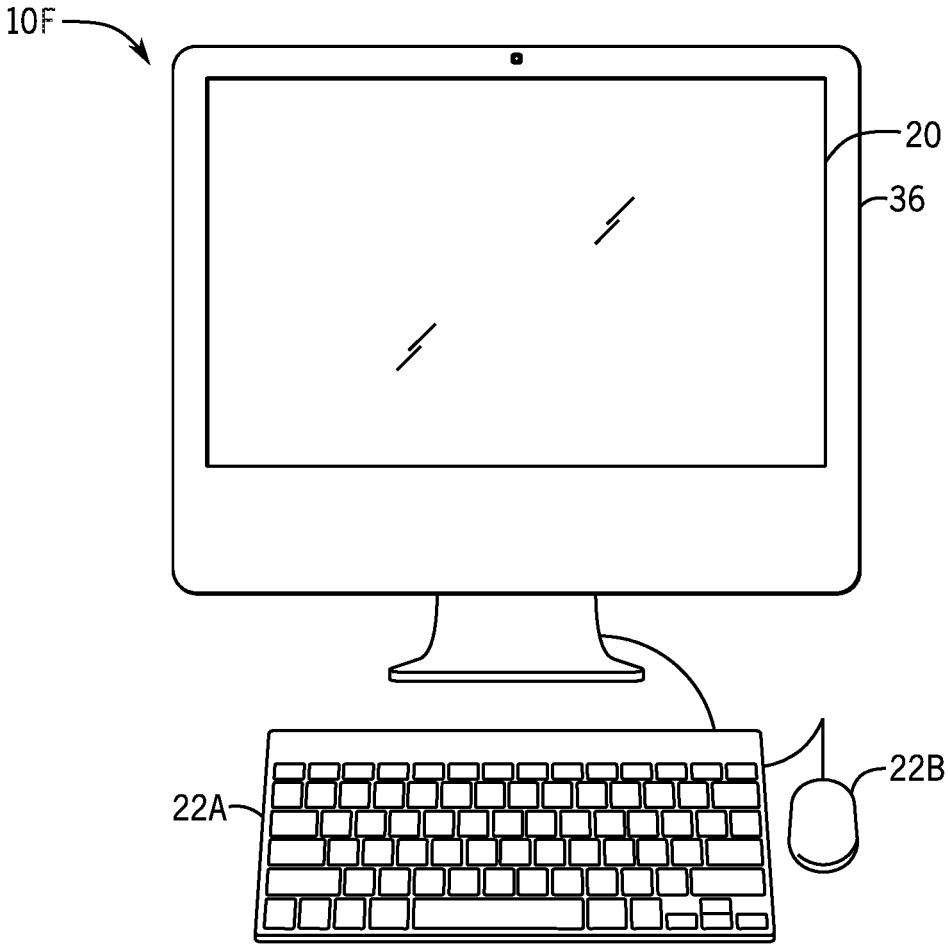
FIG. 6 is a front view of a desktop computer representing another embodiment of the electronic device of FIG. 1.

Turning to FIG. 6, a computer 10F may represent another embodiment of the electronic device systems 10A, 10B. The computer 10F may be any computer, such as a desktop computer, a server, or a notebook computer, but may also be a standalone media player or video gaming machine. By way of example, the computer 10F may be an iMac®, a MacBook®, or other similar device by Apple Inc. It should be noted that the computer 10F may also represent a personal computer (PC) by another manufacturer. A similar enclosure 36 may be provided to protect and enclose internal components of the computer 10F such as the electronic display 20. In certain embodiments, a user of the computer 10F may interact with the computer 10F using various peripheral input devices, such as input structures 22A or 22B (e.g., keyboard and mouse), which may connect to the computer 10F.

Figure 7:
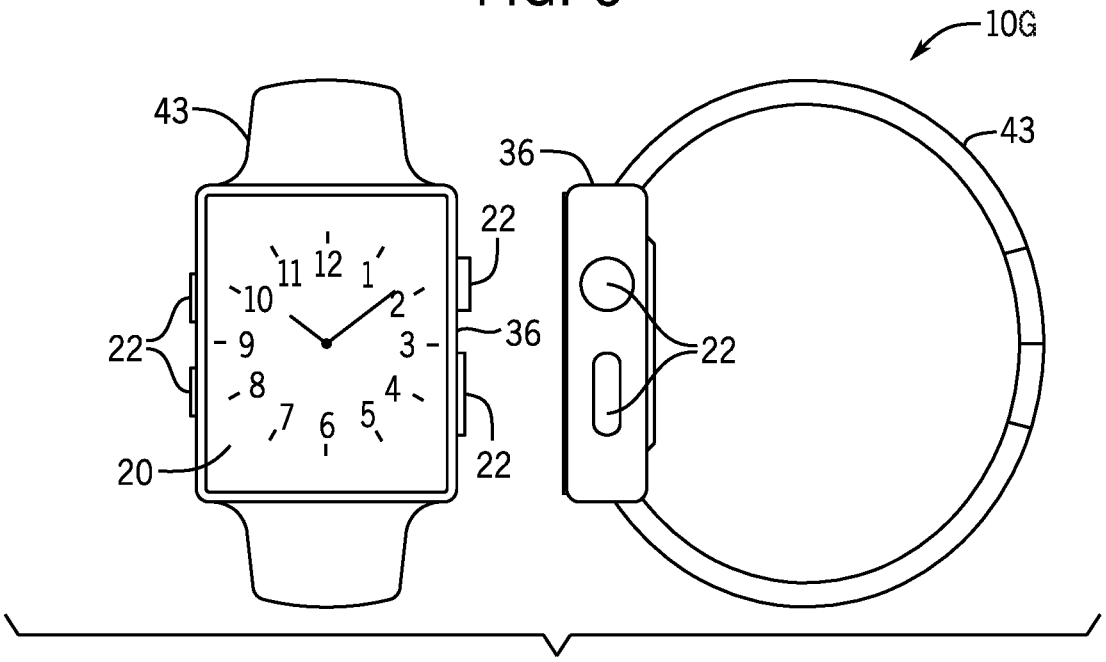
FIG. 7 is a front view and side view of a wearable electronic device representing another embodiment of the electronic device of FIG. 1.

Similarly, FIG. 7 depicts a wearable electronic device 10G representing another embodiment of the electronic device systems 10A, 10B that may be configured to operate using the techniques described herein. By way of example, the wearable electronic device 10G, which may include a wristband 43, may be an Apple Watch® by Apple Inc. However, in other embodiments, the wearable electronic device 10G may include any wearable electronic device such as, for example, a wearable exercise monitoring device (e.g., pedometer, accelerometer, heart rate monitor), or other device by another manufacturer. The electronic display 20 of the wearable electronic device 10G may include a touch screen display 20 (e.g., LCD, OLED display, active-matrix organic light emitting diode (AMOLED) display, and so forth), as well as input structures 22, which may allow users to interact with a user interface presented on the electronic display 20 of the wearable electronic device 10G.

Figure 8:
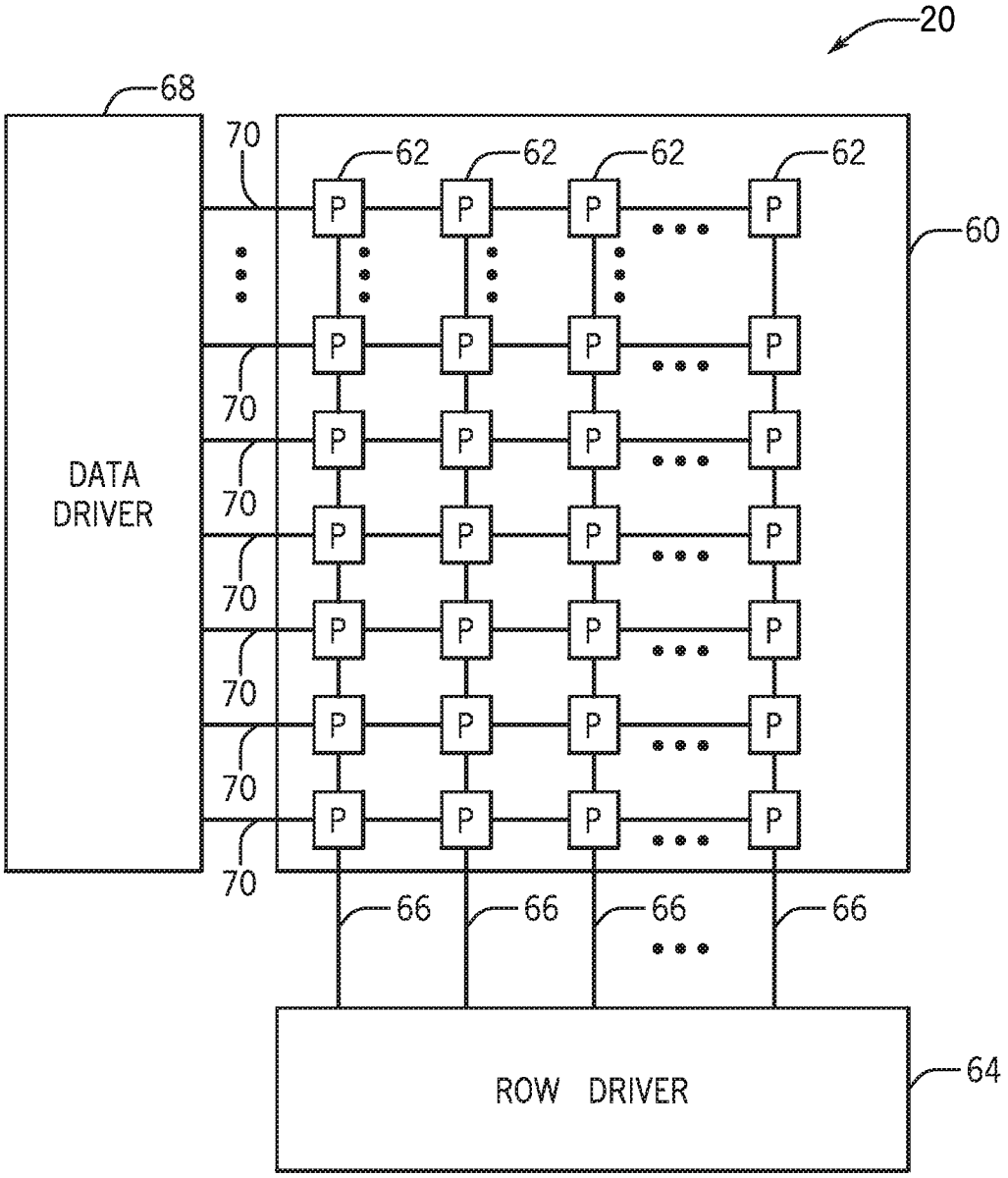
FIG. 8 is a block diagram of the electronic display of the electronic device of FIG. 1 or FIG. 2, in accordance with an embodiment.

Thus, as may be appreciated, the electronic display 20 may take any suitable form. A general example of the electronic display appears in block diagram form in FIG. 8. The electronic display 20 shown in FIG. 8 may represent a light-emitting diode (LED) display, such as organic light-emitting diode (OLED) display; a digital micromirror device (DMD) display; a liquid crystal display (LCD); and/or a static random access memory (SRAM) display; or the like. A pixel array 60 of the electronic display 20 may contain an array of pixels 62. Although the pixels 62 are shown generally aligned in rows and columns, the pixels 62 may have any arrangement. Moreover, the pixels 62 may emit different colors of light. For example, some of the pixels 62 may emit red light, some of the pixels 62 may emit green light, and some of the pixels 62 may emit blue light. The particular brightness of each pixel 62 may be programmed when a row driver 64 activates a subset of the pixels 62 for programming via a row control line 66. The row driver 64 may activate subsets of the pixels 62 one line at a time. While each subset of pixels 62 is activated for programming, a data driver 68 may provide pixel programming signals containing pixel brightness values via data lines 70 to program the subset of pixels 62 that have been activated by the row driver 64. By activating each line of pixels 62 using the row driver 64 and programming the activated pixels 62 using the data driver 68 one line at a time, the entire pixel array 60 may be programmed. This may take place every time the electronic display 20 is refreshed.

Figure 9:
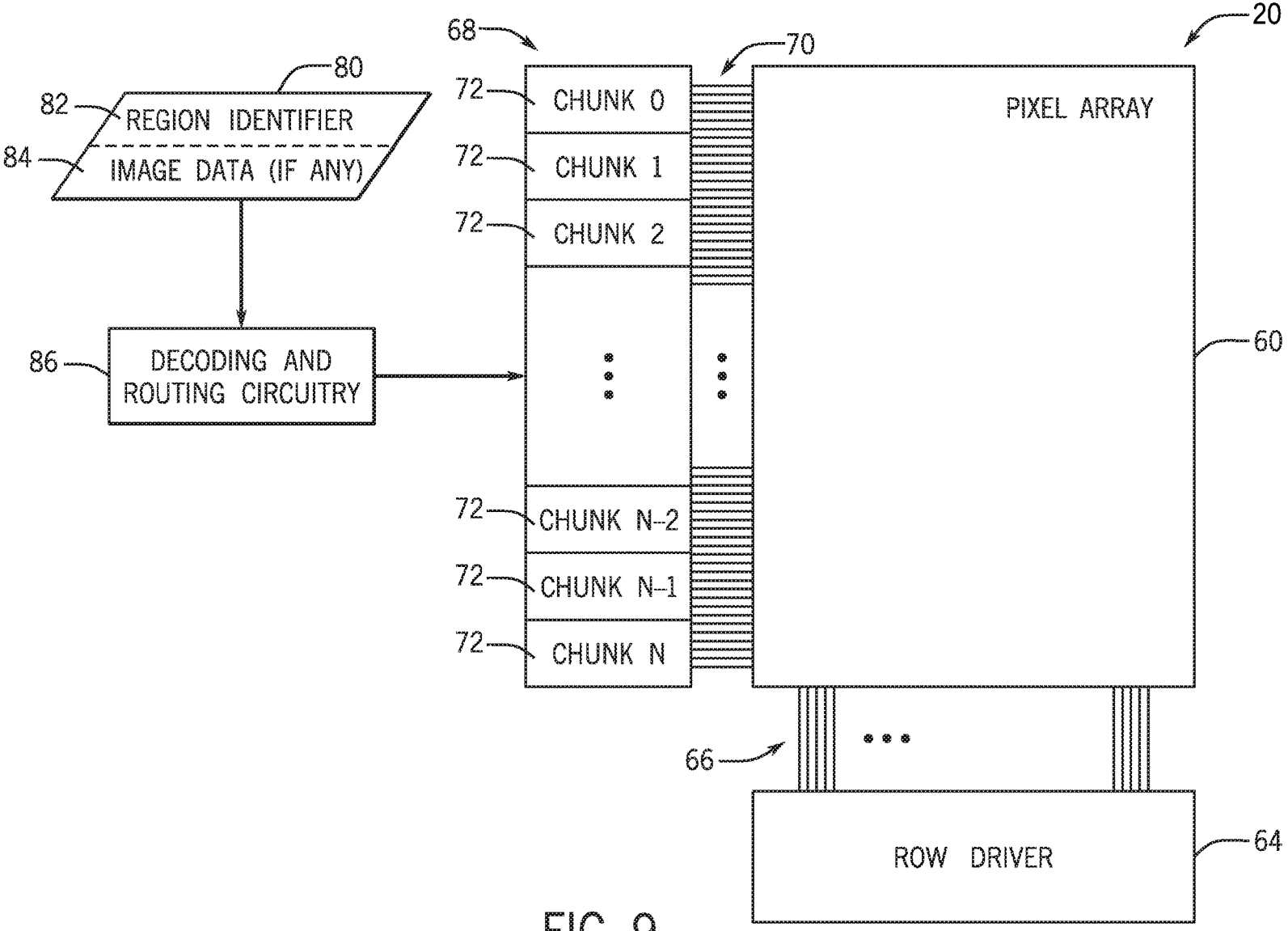
FIG. 9 is a block diagram of the electronic display that illustrates the operation of the electronic display, in accordance with an embodiment.

To reduce power consumption involved in programming each line of pixels, as well as to reduce power consumption involved in transmitting image data for programming each line of pixels to the electronic display 20, the electronic display 20 may program different regions of each line of pixels differently (e.g., depending on whether an entire region will display a default value). For example, as shown in FIG. 9, the data driver 68 may be divided into driver regions 72 that program "chunks" of image data for corresponding regions of pixels of the pixel array 60. In the example of FIG. 9, there are N+1 driver regions 72 (for programming chunk 0 to chunk N). Different driver regions 72 may each program the same number of pixels and/or dummy pixels (e.g., in the case of a line of pixels near a curved edge where the line of pixels may have fewer pixels), or different driver regions 72 may program different numbers of pixels. In one example, each driver region 72 may be connected to 64 data lines 70. Moreover, there may be any suitable number of driver regions 72. Indeed, while FIG. 9 illustrates N+1 driver regions 72 (e.g., where N+1 is 8, where N+1 is 10, where N+1 is 16, where N+1 is 20, where N+1 is 24, where N+1 is 32, or more), each of which programs a number of pixels of each line of pixels using a corresponding number of data lines 70, in one example, each driver region 72 may program only one pixel of each line of pixels, and thus there may be as many driver regions 72 as there are pixels for a line of pixels. In another example, there may be only one driver region 72 that programs all of the pixels for each line of pixels, but which may still benefit from aspects this disclosure relating to displaying default values at certain times.

Remaining elements of FIG. 9 will be described in relation to a flowchart 100 of FIG. 10. As shown in FIG. 9, the electronic display 20 may receive a compressed image data signal 80 for a subset of pixels (e.g., for a line of pixels). The compressed image data signal 80 may derive from the SoC/processing circuit(s) 12 and/or the communication interface(s) 18, which may generate image data (e.g., a frame of image data made up of lines of pixel values) and may send the compressed image data signal 80 to the electronic display 20 based on the generated image data. The compressed image data signal 80 may not necessarily include image data that is itself compressed, but the compressed image data signal 80 may avoid sending image data for any regions that would, based on the generated image data, only have pixels that display a default pixel value. Thus, for one or more lines of the display panel, the SoC/processing circuit(s) 12 and/or the communication interface(s) 18 may transmit the compressed image data signal 80 to the electronic display 20 (process block 102 of FIG. 10). The compressed image data signal 80 may include (1) a region identifier 82 that identifies which regions of one or more lines will display only a default pixel value and which the generated image data and which regions will display only a default value and (2) image data 84 (if any).

Figure 10:
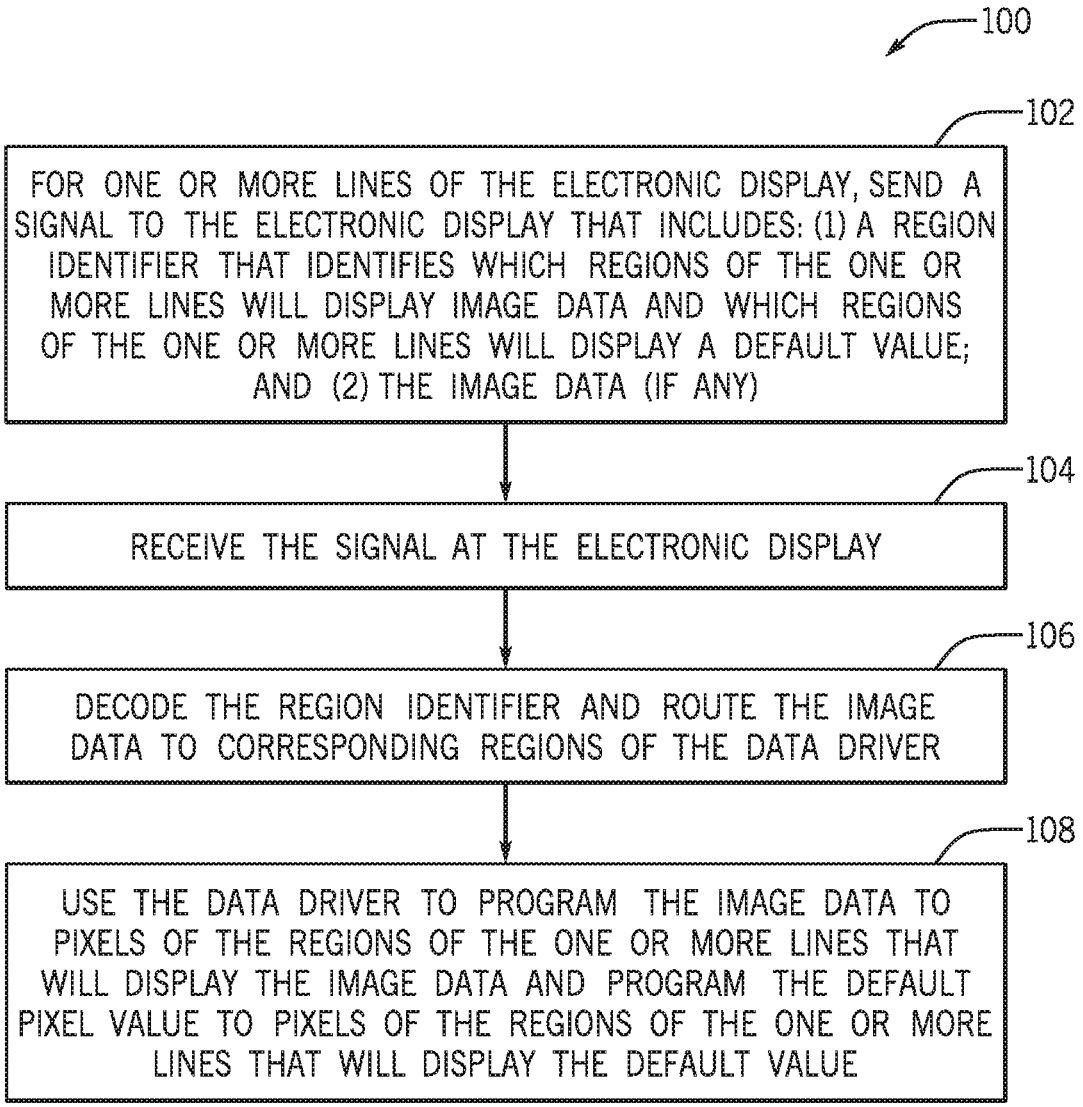
FIG. 10 is a method of operating the electronic display, in accordance with an embodiment.

The electronic display 20 may receive the compressed image data signal (process block 104 of FIG. 10). Decoding and routing circuitry 86 may decode the compressed image data signal 80 and route chunks of any received image data 84 to the corresponding driver regions 72 to which the chunks of the image data 84 pertain (process block 106 of FIG. 10). The driver regions 72 may store the received chunks of the image data 84 using any suitable storage (e.g., a buffer) for that driver region 72. Subsequently, those driver regions 72 that received a respective chunk of image data 84 may cause that chunk of image data 84 to be programmed into currently active pixels. When a driver region 72 does not receive any image data 84, however, that driver region 72 may instead program a default pixel value (e.g., a default value of a buffer of the driver region 72) into currently active pixels (process block 108 of FIG. 10). This allows the compressed image data signal 80 to avoid transmitting a chunk of image data if that chunk would have only included image data having the default value. By way of example, the default value may be a lowest gray level (e.g., black, pixel off). In this example, a line of image data with regions that are completely black could be transmitted much more efficiently using the compressed image data signal 80.

Figure 11:
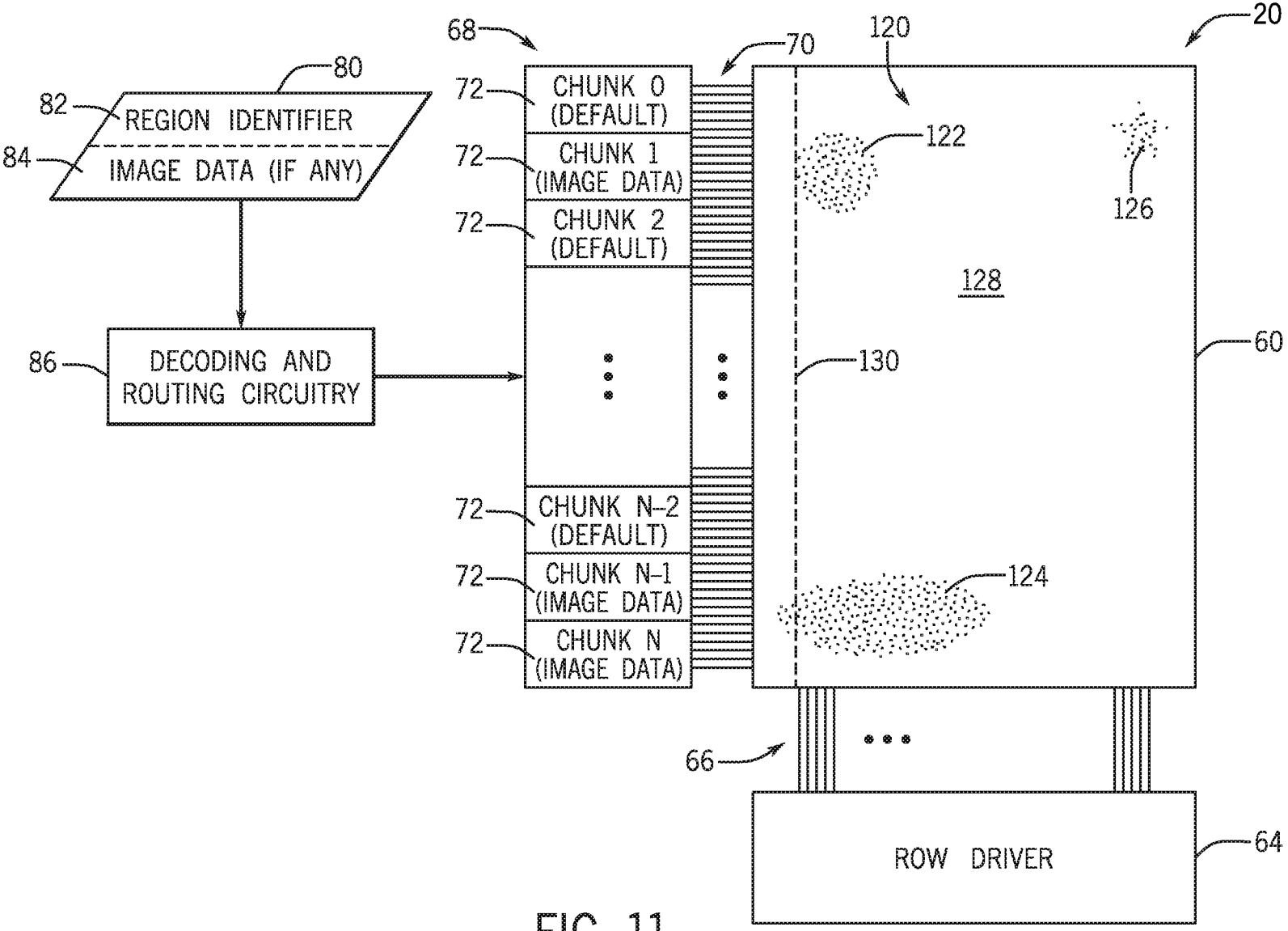
FIG. 11 is a block diagram of the electronic display that illustrates programming a line of pixels where some regions contain only a default value and some regions contain values other than the default value, in accordance with an embodiment.
Figure 12:
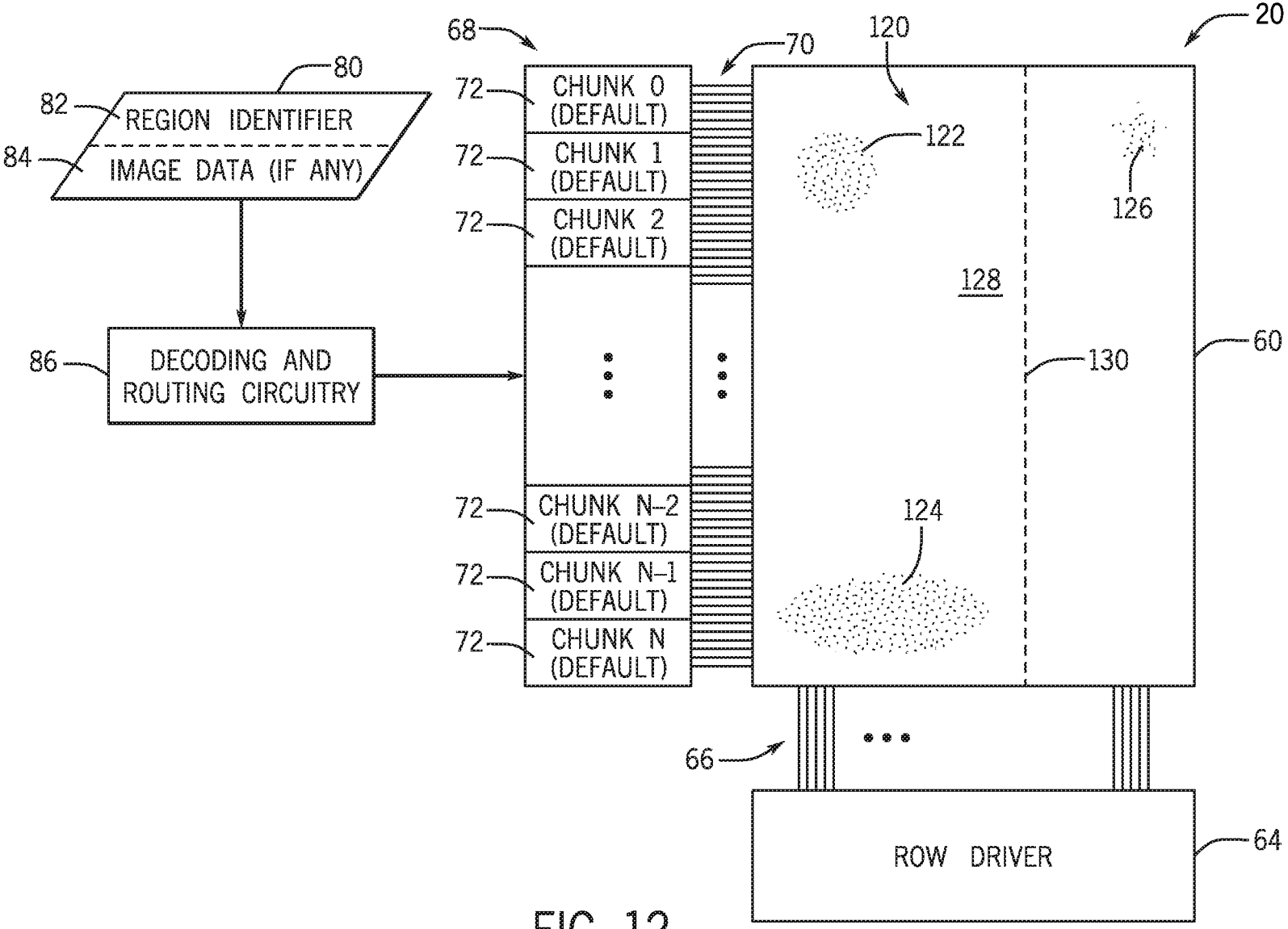
FIG. 12 is a block diagram of the electronic display that illustrates programming a line of pixels where all regions contain only a default value, in accordance with an embodiment.
Figure 13:
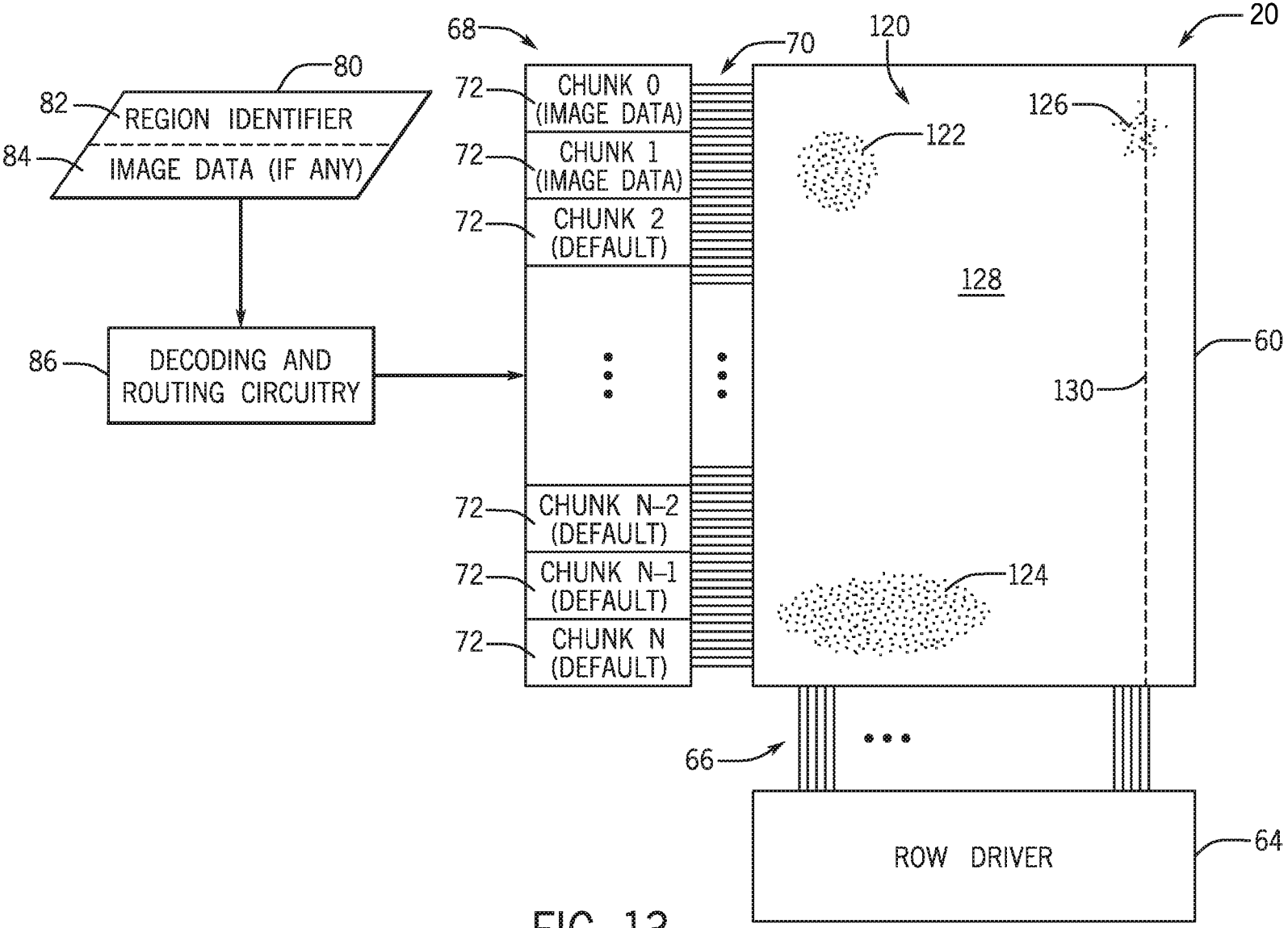
FIG. 13 is a block diagram of the electronic display that illustrates programming a line of pixels where some regions contain only a default value and some regions contain values other than the default value, in accordance with an embodiment.

FIGS. 11-13 provide one particular example of programming the electronic display 20 in accordance with the method of FIG. 10. In the example of FIGS. 11-13, an image 120 that will be programmed into the pixel array 60 includes several image elements 122, 124, and 126 that will have pixel values other than a default value. A background 128 of the image 120 will have the default value (e.g., a lowest gray level or a highest gray level). The image 120 is programmed one line 130 of the pixel array 60 at a time.

FIGS. 11, 12, and 13 respectively represent the electronic display 20 as different lines 130 of the pixel array 60 are programmed to display the image 120. In FIG. 11, the line 130 of the pixel array 60 covers a portion of the image elements 122 and 124. These portions of the image elements 122 and 124 occur in only certain regions, namely, in the regions for "chunk 1," "chunk N−1," and "chunk N." The rest of the line 130 of the pixel array 60 is for the background 128 and will display the default pixel value. As such, the compressed image data signal 80 may only include image data for "chunk 1," "chunk N−1," and "chunk N." Therefore, the region identifier 82 may indicate that the image data 84 includes image data for only the regions associated with those chunks. The decoding and routing circuitry 86 may send those respective chunks of image data to the appropriate driver regions 72 based on the region identifier 82. Thus, the driver regions 72 for "chunk 1," "chunk N−1," and "chunk N" receive that image data and program those respective regions of the line 130 of the pixel array 60 with the received image data. All other driver regions 72, which did not receive any image data for this line 130, will program the default pixel value into their regions of the line 130.

In FIG. 12, the line 130 of the pixel array 60 represents the background 128 of the image 120 and will display the default pixel value. Therefore, the compressed image data signal 80 includes no image data because the line 130 of the pixel array 60 will only display the default pixel value. The region identifier 82 may indicate that the image data signal 80 includes no image data 84 for this line 130 of the pixel array 60. Consequently, the decoding and routing circuitry 86 has no image data to send to any driver regions 72. Accordingly, all of the driver regions 72 will program the default pixel value into their regions of the line 130.

In FIG. 13, the line 130 of the pixel array 60 covers a portion of the image element 126 in the regions for "chunk 0" and "chunk 1." The rest of the line 130 of the pixel array 60 is for the background 128 and will display the default pixel value. As such, the compressed image data signal 80 may only include image data for "chunk 0" and "chunk 1." Therefore, the region identifier 82 may indicate that the image data 84 includes image data for only the regions associated with those chunks. The decoding and routing circuitry 86 may send those respective chunks of image data to the appropriate driver regions 72 based on the region identifier 82. Thus, the driver regions 72 for "chunk 0" and "chunk 1" receive that image data and program those respective regions of the line 130 of the pixel array 60 with the received image data. All other driver regions 72, which did not receive any image data for this line 130, will program the default pixel value into their regions of the line 130.

Figure 14:
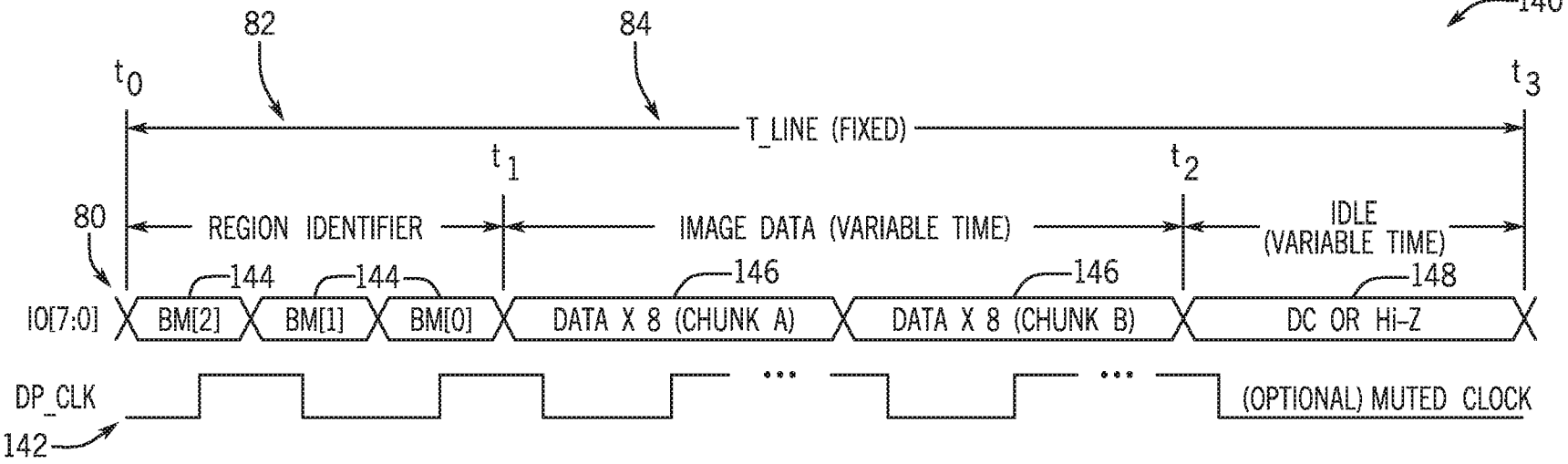
FIG. 14 is a timing diagram of a compressed image data signal that contains a region identifier and any image data for a line of pixels, in accordance with an embodiment.

The compressed image data signal 80 may take any suitable form that includes a region identifier 82 and any corresponding image data 84. A timing diagram 140 shown in FIG. 14 represents one example of a form the compressed image data signal 80 may take. In the example of FIG. 14, the compressed image data signal 80 is shown alongside a display panel clock (DP_CLK) 142 over a time period (t_line), which may represent an amount of time it may take to receive the image data for a line of pixels of the pixel array. The region identifier 82 occurs between a time t0 and t1, and any image data 84 may be transmitted thereafter from a time t1 to t2. Because the amount of image data 84 that is received may vary depending on which regions will display a default pixel value (and therefore image data for those regions may not be transmitted), the time t2 may change for different compressed image data signals 80. Once the image data 84 has been sent, the communication channel over which the compressed data signal 80 has been sent may be idle between time t2 and t3, saving power. Correspondingly, the display panel clock (DP_CLK) 142 may also be muted for additional power savings between times t2 and t3.

The region identifier 82 may also take a variety forms. In the example of FIG. 14, the region identifier 82 is a header, and the image data 84 portion is a payload. The region identifier 82 may take the form of a bitmap signal broken into three bytes 144. As will be discussed further below, the region identifier 82 in the form of a bitmap may digitally identify each region by one bit that, when set to a first state (e.g., "1"), will display image data that will follow in the image data 84 portion of the signal and, when set to a second state (e.g., "0"), will display only a default pixel value. The image data 84 portion of the compressed image data signal 80 may be sent in defined chunks 146 of any suitable size. The chunks 146 may themselves be compressed according to any other suitable algorithm if desired. An idle 148 signal may be any suitable low-power state, such as high-impedance (Hi-Z) or a single direct current (DC) value (e.g., a low-voltage signal, such as substantially 0 volts).

Figure 15:
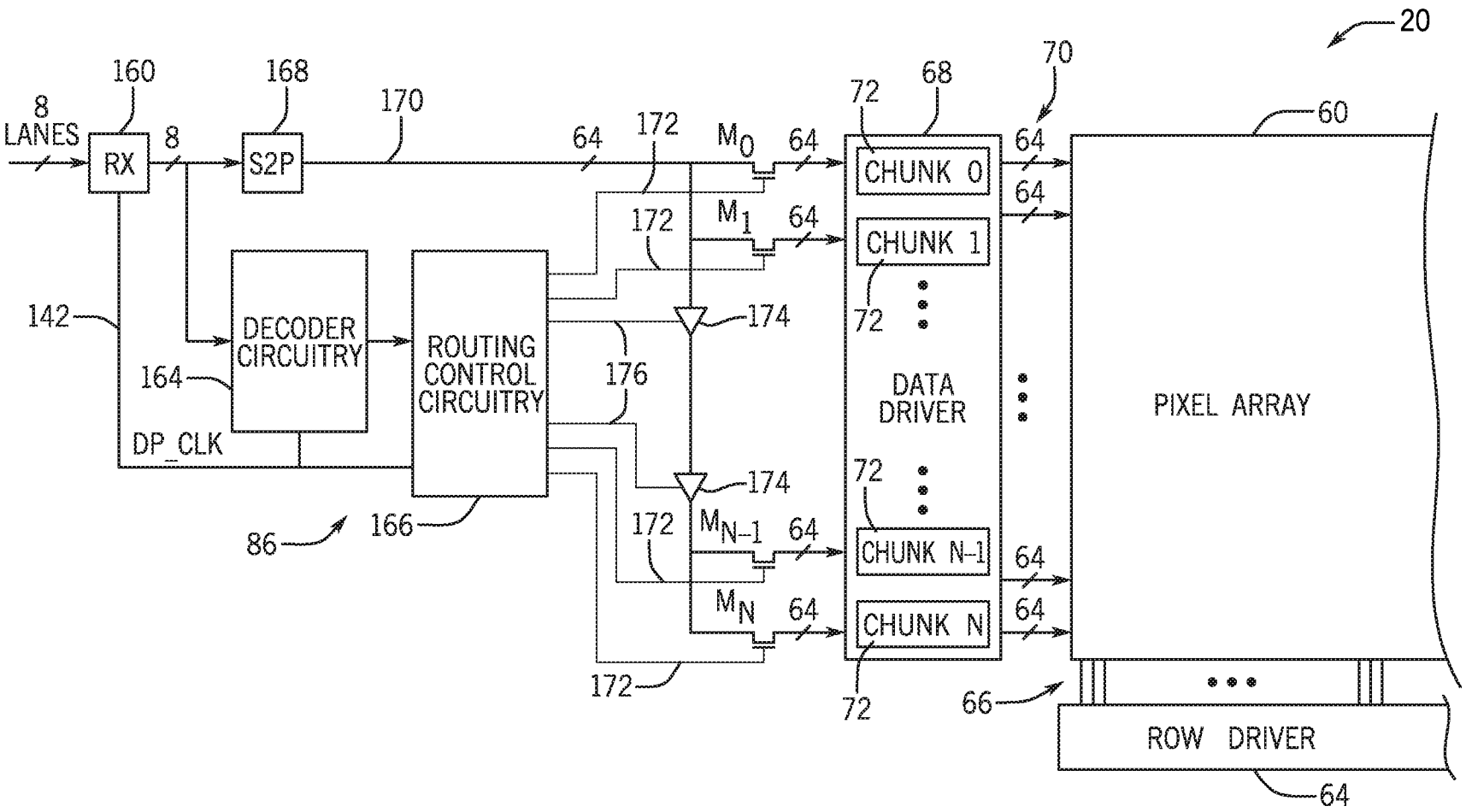
FIG. 15 is a block diagram of an example of decoding and routing circuitry of the electronic display, in accordance with an embodiment.

FIG. 15 illustrates a particular example of the electronic display 20 that shows an example layout of the decoding and routing circuitry 86. In particular, receiver (RX) circuitry 160 may receive the compressed image data signal 80 on a communication channel (e.g., an 8-lane input-output (IO) of the electronic display 20, which may be received via a wired or wireless physical channel). The RX circuitry 160 may generate the display panel (DP_CLK) signal 142 or may receive the display panel (DP_CLK) signal 142 from another source. The RX circuitry 160 may mute the display panel (DP_CLK) signal 142 when the communication channel and/or the compressed image data signal 80 are idle. Decoder circuitry 164 may receive at least the region identifier 82. The decoder circuitry 164 may identify which driver regions 72 will receive chunks of image data 84 in the compressed image data signal 80. Thus, the decoder circuitry 164 may cause routing control circuitry 166 to route the received chunks of image data 84 to their proper driver region 72.

Figure 16:
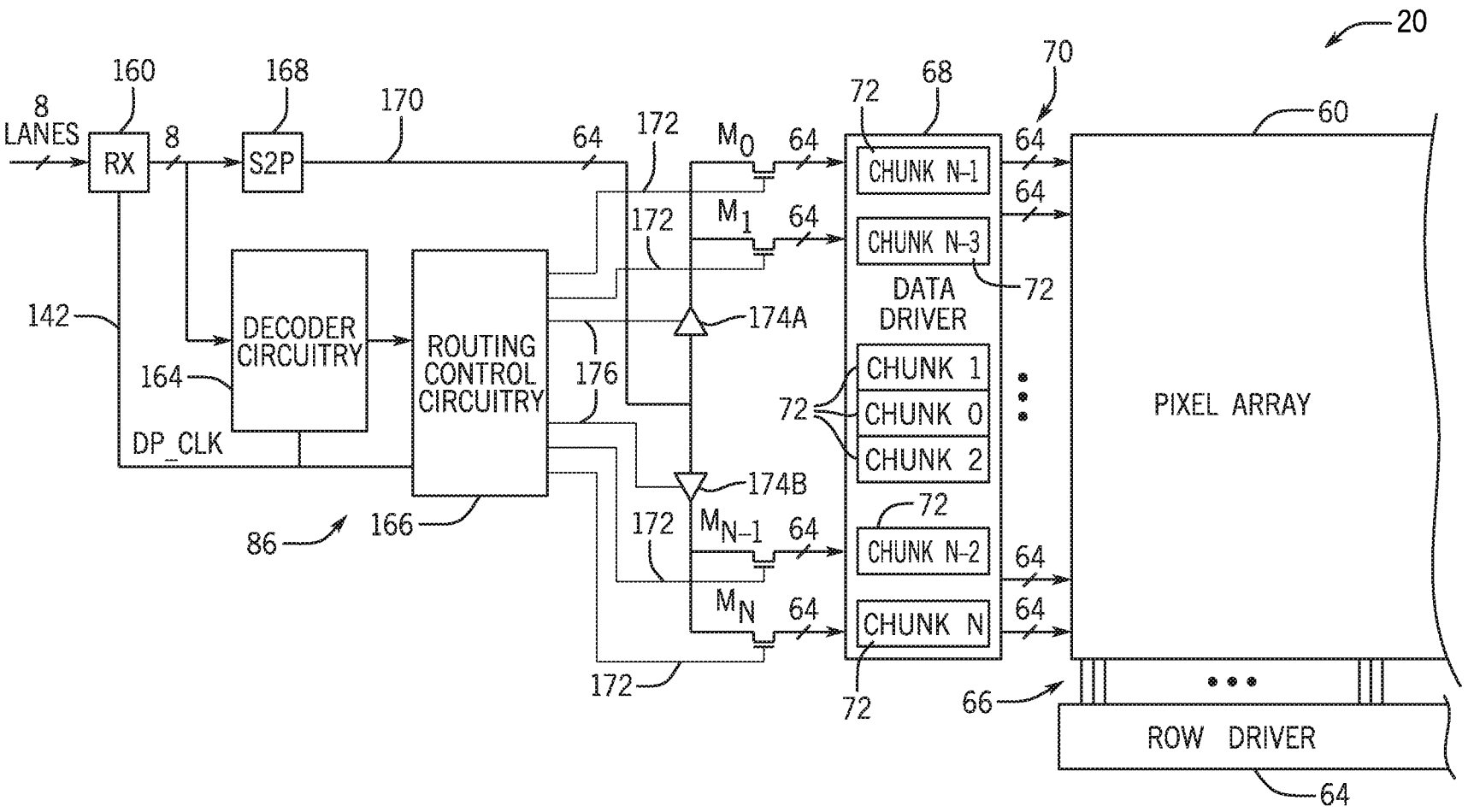
FIG. 16 is a block diagram of another example of decoding and routing circuitry of the electronic display, in accordance with an embodiment.

In one example, a serial-to-parallel (S2P) circuit 168 may receive data on a lower number of lanes (e.g., 8 lanes) and parallelize the data onto a higher number of lanes (e.g., 64 lanes) of a bus 170. Any suitable number of lanes may be chosen. In the example of FIG. 15, the number of lanes of the bus 170 corresponds to the number of data lines 70 of each driver region 72. The routing control circuitry 166 may provide an enable signal 172 to a particular switch M (e.g., $M_0$, $M_1$, . . . $M_{N-1}$, $M_N$) according to a timing indicated by the decoder circuitry 164. Consider an example where the image data 84 that is received corresponds to chunk 1 and chunk N. In that case, the switch $M_1$ may be activated while the image data corresponding to chunk 1 is routed to the corresponding driver region 72 and then the switch $M_N$ may be activated while the image data corresponding to chunk N is routed to that corresponding driver region 72. The enable signal 172 may be a one-hot signal (e.g., either on or off). For further power savings, unused portions of the bus 170 may be selectively turned on or off by transmitting to bus drivers 174 a control signal 176 (e.g., a thermal code). Indeed, the bus 170 may take any suitable shape to increase the amount of time spent in a sleep mode. For example, as shown in FIG. 16, the bus 170 may be divided between an area above an upper bus driver 174A and an area below a lower bus driver 174B. The various chunks of image data 84 may be distributed to the various driver regions 72 in any suitable fashion.

Figure 17:
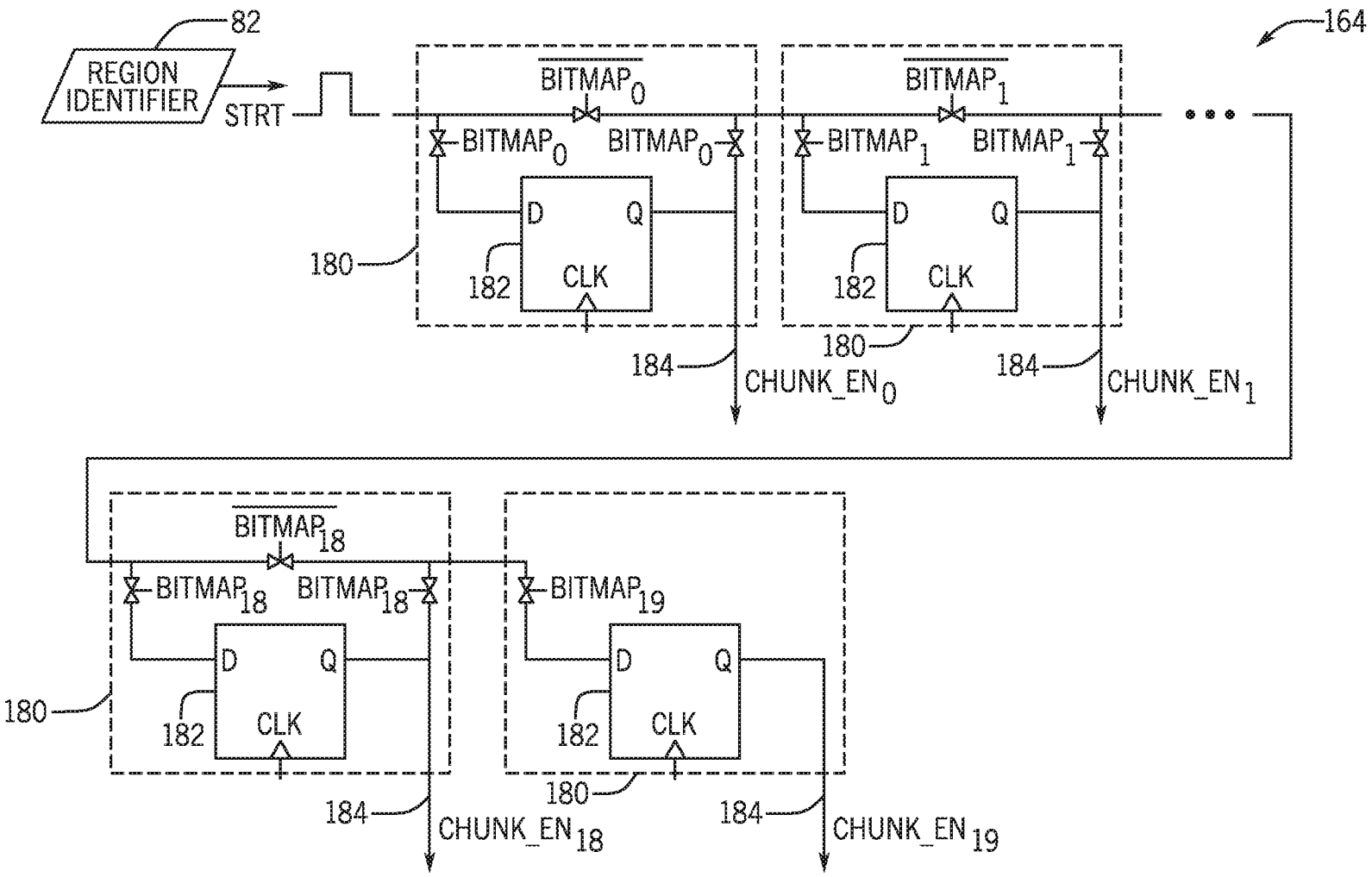
FIG. 17 is a block diagram of an example of decoding circuitry of the decoding and routing circuitry, in accordance with an embodiment.

The decoder circuitry 164 may decode the region identifier 82 in any suitable way. When the region identifier 82 represents a bitmap with "1" signals indicating regions that will receive image data and "0" signals indicating regions that will not receive image data, but will instead display the default pixel value, the decoder circuitry 164 may take the form shown in FIG. 17. In FIG. 17, the decoder circuitry 164 includes a series of shift registers 180 containing flip-flop circuits 182. As the region identifier 82 shifts through the decoder circuitry 164, specific output enable signals 184 for particular regions may be generated as high or low based on the bitmap of the region identifier 82. The enable signals 184 may be provided as the enable signals 172.

Figure 18:
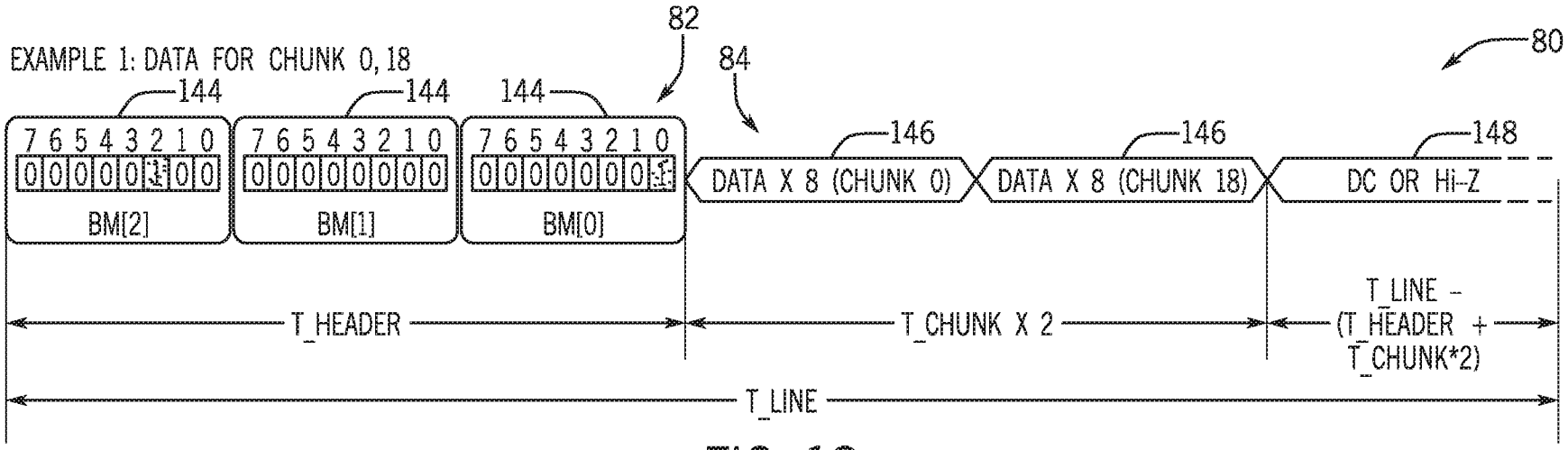
FIG. 18 is a timing diagram representing one example of a compressed image data signal for a line of pixels, in accordance with an embodiment.
Figure 19:
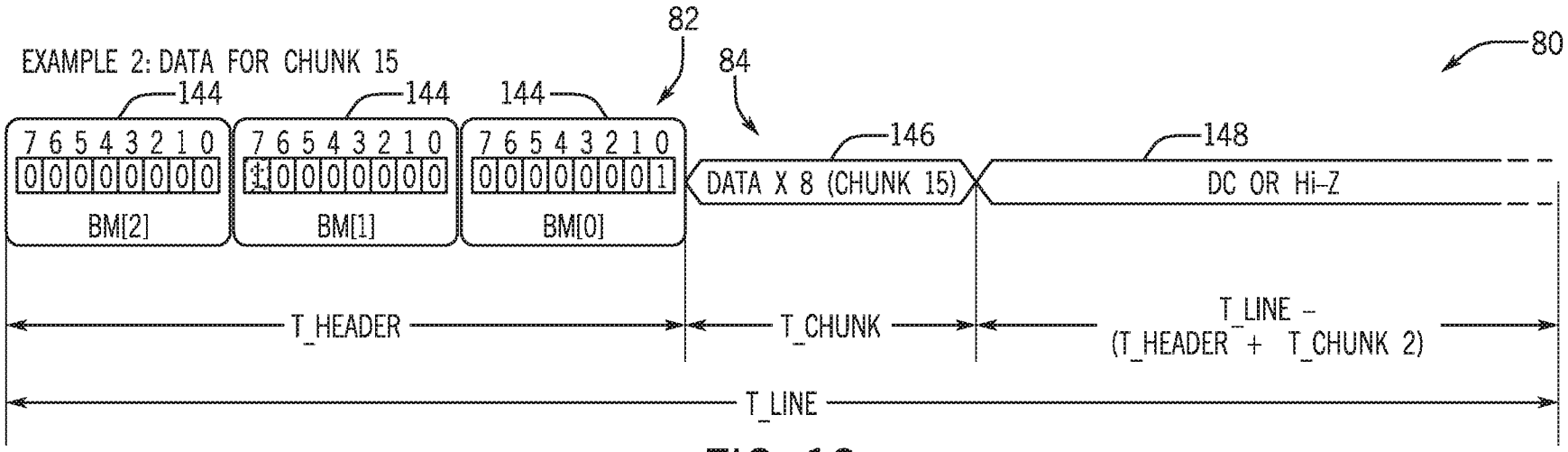
FIG. 19 is a timing diagram representing one example of a compressed image data signal for another line of pixels, in accordance with an embodiment.

FIGS. 18 and 19 provide a few specific examples of the compressed image data signal 80 in which the region identifier 82 takes the form of a bitmap. In the example of FIG. 18, the region identifier 82 indicates that image data will be received for chunks "O" and "18." The bitmap of the region identifier 82 indicates this by providing a "1" value at bit 0 of byte 0 and a "1" value at bit 2 of byte 2 of the bytes 144. Thus, the following two chunks 146 that are received are for chunk 0 and then chunk 18, and then the signal is idle 148. In the example of FIG. 19, the region identifier 82 indicates that image data will be received for chunk "15." The bitmap of the region identifier 82 indicates this by providing a "1" value at bit 7 of byte 1 of the bytes 144. Thus, the following chunk 146 that is received is for chunk 15, and then the signal is idle 148.

Figure 20:
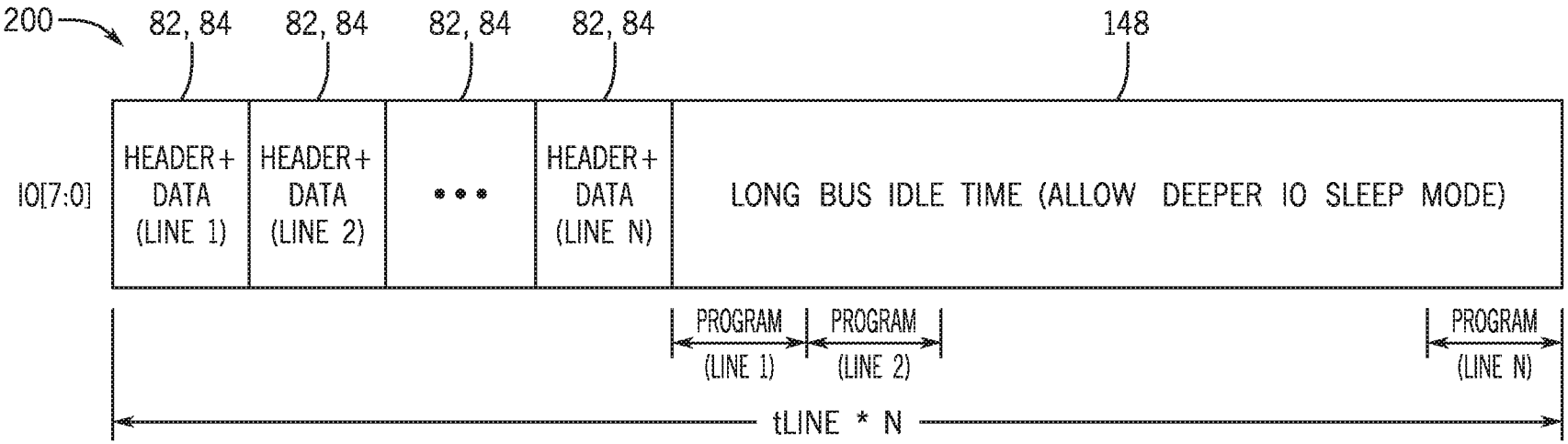
FIG. 20 is a timing diagram of a compressed image data signal for several lines of pixels to enable deeper sleep modes, in accordance with an embodiment.

While the compressed image data signal 80 may be received on a per-line basis, in some cases, the compressed image data signal 80 may contain data for several lines of pixels. This may allow for a longer contiguous idle period, allowing for deeper sleep modes and greater power savings. For example, as shown by a timing diagram 200 of FIG. 20, the compressed image data signal 80 may include several groupings of a region identifier 82 and corresponding image data 84 for one line each. Thus, the compressed image data signal 80 may include a region identifier 82 and image data 84 (if any) for each line (e.g., of N total lines, which may be any suitable number of lines up to an entire frame of lines, and which may be a different number N from the total number of driver regions 72). An idle 148 period thereafter may be longer than any single idle time for a given line. This may allow for deeper I/O sleep modes and greater power savings.

Figure 21:
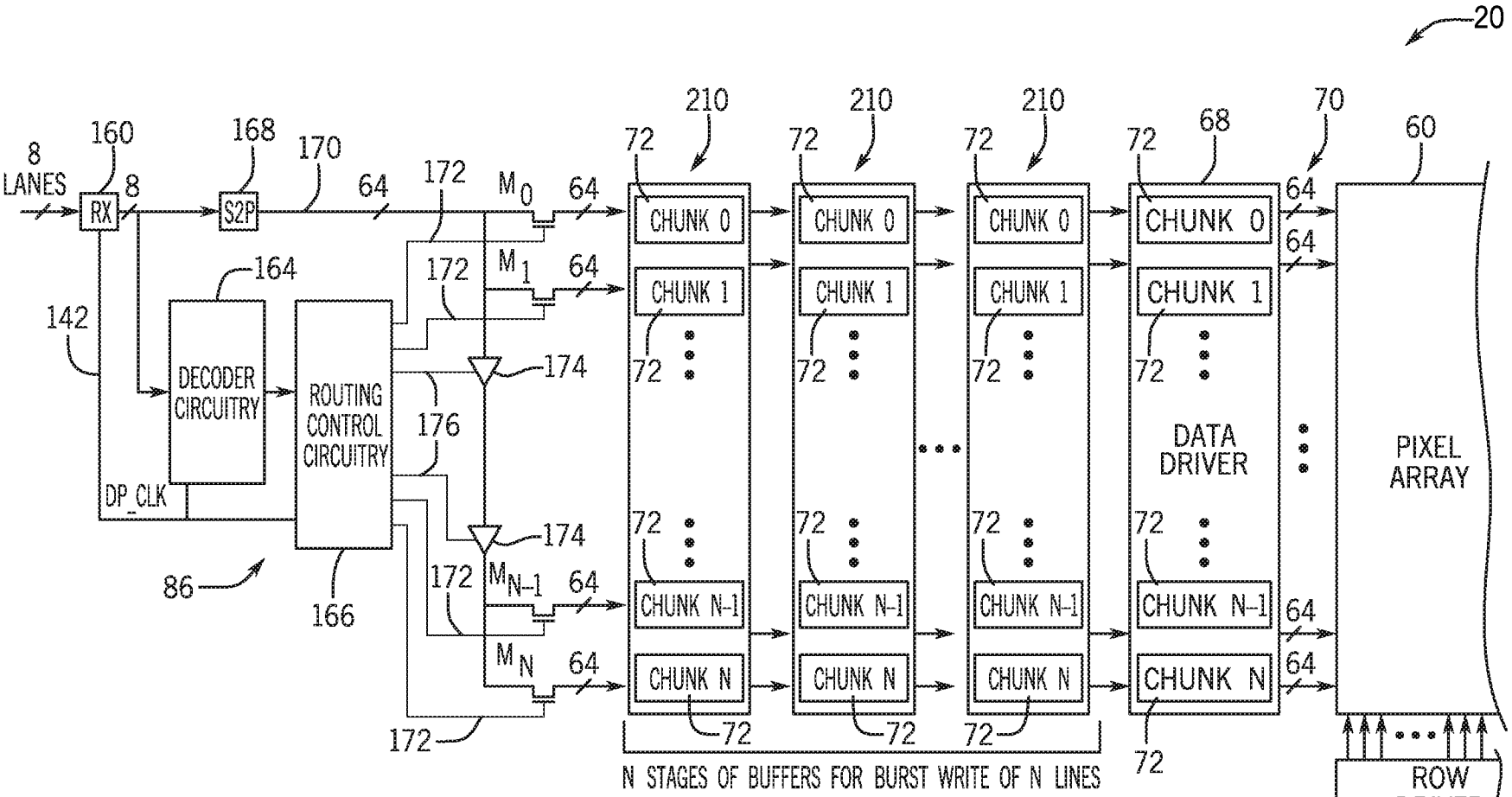
FIG. 21 is a block diagram of an example of decoding and routing circuitry of the electronic display that can process the compressed image data signal of FIG. 20, in accordance with an embodiment.

To support such a scheme, the electronic display 20 may contain additional buffer stages 210, as shown in FIG. 21.

The additional buffer stages 210 may be sufficient to store any received chunks of the N lines of image data that are received from a compressed image data signal 80 that contains information for those N lines, as mentioned above with reference to FIG. 20. As also mentioned above, the number N of lines may be unrelated to the number N used to describe the driver regions 72. In other respects, the electronic display 20 of FIG. 21 may operate in substantially the same way as described above with reference to FIG. 15.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic display comprising:

a plurality of pixels;

a row driver configured to activate a first subset of the plurality of pixels for programming;

receiver circuitry configured to receive a first compressed image data signal, wherein the first compressed image data signal comprises a header and a payload, wherein the header comprises a region identifier that indicates at least one region of a plurality of regions of contiguous pixels within the first subset of the pixels that has image data in the payload, wherein the payload only includes image data for the at least one region, wherein the at least one region includes fewer than all regions of the plurality of regions; and a data driver configured to:

receive the image data for the at least one region of the plurality of regions; and while the first subset of the pixels is activated for programming, program image data to respective pixels of the first subset of the pixels in the at least one region and program a default pixel value to respective pixels of the first subset of the pixels outside of the at least one region.

2. The electronic display of claim 1, wherein each region of the plurality of regions of contiguous pixels has the same number of pixels.

3. The electronic display of claim 2, wherein each region of the plurality of regions of contiguous pixels comprises sixty-four pixels.

4. The electronic display of claim 1, wherein not all of the regions of the plurality of regions of contiguous pixels have the same number of pixels.

5. The electronic display of claim 1, wherein the data driver comprises:

first buffers configured to store image data for the respective pixels of a first region of the at least one region of the plurality of regions; and second buffers configured to concurrently store image data for respective pixels of a second region of the at least one region of the plurality of regions, wherein the row driver is configured to activate the respective pixels of the second region for programming after the first subset of the pixels have been programmed.

6. The electronic display of claim 1, wherein the default pixel value comprises a lowest gray level pixel value.

7. The electronic display of claim 1, wherein the default pixel value comprises a highest gray level pixel value.

8. The electronic display of claim 1, wherein the default pixel value comprises a stored pixel value from a previous frame of image data.

9. The electronic display of claim 1, wherein the first subset of the pixels comprises one line of the plurality of pixels on the electronic display.

10. The electronic display of claim 1, wherein the electronic display comprises:

decoder circuitry configured decode the header to identify the at least one region by identifying any region of the plurality of regions that has corresponding image data in the payload; and routing circuitry configured to route any image data received in the payload to regions of the data driver that correspond to the at least one region.

11. The electronic display of claim 10, wherein the decoder circuitry comprises a bitmap decoder configured to decode a bitmap of the header that indicates, for each region of the plurality of regions of contiguous pixels of the first subset of the pixels, whether that region has corresponding image data in the payload.

12. A method comprising:

receiving a first signal at an electronic display, wherein the electronic display includes a first line of pixels and a second line of pixels, and wherein the first signal comprises:

image data for a first region of contiguous pixels of the first line of pixels, wherein the image data does not include any image data for a second region of contiguous pixels of the first line of pixels, wherein each pixel of the second region of the first line of pixels is to display a default pixel value; and a first region identifier that identifies the first region of the first line of pixels and the second region of the first line of pixels that are to display the default pixel value;

routing the image data for the first region of the first line of pixels to a corresponding region of a data driver of the electronic display based at least in part on the first region identifier;

programming, using the data driver, the image data for the first region of the first line of pixels to the first region of the first line of pixels; and programming, using the data driver, the default pixel value to the second region of the first line of pixels.

13. The method of claim 12, wherein receiving the first signal comprises receiving the first signal via a communication channel, wherein the communication channel is configured to enter a lower-power state once the first signal has been received.

14. The method of claim 12, wherein the first signal comprises a header and a payload, wherein the header comprises the first region identifier and the payload comprises the image data.

15. The method of claim 12, comprising:

receiving a second signal at the electronic display, wherein the second signal comprises:

a second region identifier that identifies a first region of the second line of pixels that are to display image data and a second region of the second line of pixels that are to display the default pixel value; and the image data for the first region of the second line of pixels;

routing the image data for the first region of the second line of pixels to a corresponding region of the data driver of the electronic display based at least in part on the second region identifier;

programming, using the data driver, the image data for the first region of the second line of pixels to the first region of the second line of pixels; and programming, using the data driver, the default pixel value to the second region of the second line of pixels.

16. The method of claim 15, wherein receiving the first signal and the second signal comprises receiving the first signal and the second signal via a communication channel; and the communication channel is configured to enter a lower-power state once the first signal and the second signal have both been received.

17. A system comprising:

processing circuitry of an electronic device configured to:

generate a line of image data corresponding to a line of pixels of an electronic display; and transmit a first signal to the electronic display via a communication channel to cause the line of image data to be displayed on the line of pixels of the electronic display without transmitting the entire line of image data, wherein the first signal:

identifies a first portion of a plurality of portions of the line of image data corresponding to at least a first region of a plurality of regions of the line of pixels to be programmed to a default value; and includes image data only for a second portion of the plurality of portions of the line of image data that do not include only the default value, wherein the second portion of the plurality of portions corresponds to at least a second region of the plurality of regions of the line of pixels to be programmed with the image data.

18. The system of claim 17, wherein the processing circuitry of the electronic device is configured to cause the communication channel to enter a lower-power mode after transmission of the first signal to the electronic display.

19. The system of claim 17, comprising:

the electronic display, wherein the electronic display is configured to:

receive the first signal via the communication channel;

identify, based on the first signal, the at least a first region of the plurality of regions of the line of pixels;

program the default value to pixels of the at least a first region of the plurality of regions of the line of pixels; and program the image data to pixels of the at least a second region of the plurality of regions of the line of pixels.

20. The system of claim 19, wherein the electronic display is integrated in a housing of the electronic device with the processing circuitry of the electronic device.

21. The system of claim 20, wherein the electronic device comprises a computer, a portable electronic device, or a wearable electronic device.

22. The system of claim 19, wherein the electronic display is external to the electronic device.

* * * * *